US005859493A

United States Patent [19]

Kim

[11] Patent Number: 5,859,493

[45] Date of Patent: Jan. 12, 1999

[54] LATERAL FIELD EMISSION DISPLAY WITH POINTED MICRO TIPS

[75] Inventor: Jong-min Kim, Seoul, Rep. of Korea

[73] Assignee: Samsung Display Devices Co., Ltd., Suwon, Rep. of Korea

[21] Appl. No.: 667,874

[22] Filed: Jun. 20, 1996

[30] Foreign Application Priority Data

| | | | |
|---|---|---|---|
| Jun. 29, 1995 | [KR] | Rep. of Korea | 1995-18116 |
| Nov. 14, 1995 | [KR] | Rep. of Korea | 1995-41247 |
| Nov. 14, 1995 | [KR] | Rep. of Korea | 1995-41248 |

[51] Int. Cl.[6] ..... H01J 1/02; H01J 9/02

[52] U.S. Cl. ..... 313/309; 313/336; 313/351; 445/24; 445/50

[58] Field of Search ..... 313/309, 336, 313/351, 308, 310, 355; 445/24, 49, 50

[56] References Cited

U.S. PATENT DOCUMENTS

| | | | |
|---|---|---|---|
| 5,233,263 | 8/1993 | Cronin et al. | 313/309 |
| 5,386,172 | 1/1995 | Komatsu | 313/336 |
| 5,502,314 | 3/1996 | Hori | 313/351 |

*Primary Examiner*—Sandra L. O'Shea
*Assistant Examiner*—Joseph Williams
*Attorney, Agent, or Firm*—Burns, Doane, Swecker & Mathis, L.L.P.

[57] ABSTRACT

A lateral field emission display in which a cathode and anode are laterally arrayed, and a fabricating method thereof, since the micro tip is formed to be sharp through the reactive ion etching method, efficiency of electron emission is better than a conventional wedge-type tip. Also, since focusing of an electron beam is accurately controlled, a relatively low-voltage driving is possible. Further, since the first gate is further provided above the cathode and the anode is formed to be higher than the second gate, a trace control of an electron-beam emitted from the micro tip is easy and focusing efficiency of the emitted electron beam to the anode is also improved.

10 Claims, 10 Drawing Sheets

LATERAL FIELD EMISSION DISPLAY WITH POINTED MICRO TIPS

BACKGROUND OF THE INVENTION

The present invention relates to a flat type image display, and more particularly, to a lateral field emission display in which the cathode and anode are laterally arrayed, and a fabricating method thereof.

Currently, a flat type image display is under development as an image display for a wall-mounted television or an HDTV. As such a flat type display, there is a liquid crystal display, a plasma display panel and a field emission display. Among those, the field emission display attracts much attention due to its brighter screen and lower power consumption.

FIG. 1 illustrates a sectional view of a portion of a conventional vertical field emission display. Referring to the drawing, a plurality of cathodes 12 are formed in a stripe pattern on a glass substrate 11. A plurality of micro tips 14 for emitting a electron beam are formed in an array on the cathodes 12. An insulating layer 13 which encloses the micro tips 14 formed on the cathode 12. A plurality of gates 15 which are formed to the cathodes 12 are provided on the insulating layer 13 and have an aperture 16 across which an electric field is induced above each micro tip 14.

In a fabricating method of the vertical field emission display having such a structure, i.e., a process of forming a micro tip array of several tens of nm, a highly microscopic process in sub-micron units is required for an etching process in accordance with a tip size (radius) and a gate aperture size. Namely, if the sharpness of the micro tip is not uniformly maintained, there may be a problem in displaying a uniform image. Thus, the maintenance of uniformity throughout the fabricating process is necessary for obtaining uniform sharpness of the micro tip.

Also, in the vertical field emission display, it is difficult to establish a RGB (red, green and blue) alignment in a process of coating a fluorescent material 18 on the glass-window 19. Proper alignment is necessary since electrons emitted due to an electric field effect formed on the micro tip hit the fluorescent material 18 to emit light. Further, since the present display adopts a light transmitting method, a clear image can be seen only when the fluorescent material 18 itself is thin, which causes difficulty in the fluorescent material coating process.

To overcome the above-referred defects, a conventional lateral field emission display as shown in FIG. 2 is suggested. Referring to FIG. 2, the display comprises a cathode 23 having sharp tips 23*a* of a wedge shape on a substrate 21, a gate 24 and a anode 25. The cathode 23, the gate 24 and the anode 25 are disposed in parallel at a set distance laterally on insulating layers 22*a*, 22*b* and 22*c*, respectively. The overhead view of a tip of the lateral field emission display is a triangular shape as shown in FIG. 3A.

The fabricating method of the lateral field emission display having such a structure will now be described.

The cathode 23 having the wedge-shaped micro tip 23*a* of FIG. 2 is formed by depositing metal for the cathode, gate and anode, respectively, after growing an insulating material on the substrate 21, and etching the deposition using a reactive ion etching method. Then, the gate 24 and the anode 25 are formed in the same way, and the grown insulating material is patterned by using them as a mask.

However, there is a limit in making the metal micro tip 23*a* sharp by using only the reactive ion etching method after the metal film is deposited as described above. That is, as shown in FIG. 3B, however the wedge is sharpened, the tip portion is a line 26, not a point. Thus, when a bias voltage is applied between the wedge-shaped micro tip 23*a* and the gate 24, the electric field effect cannot be highly concentrated. Thus, the emission of electrons is small and leakage current increases due to stray electrons 27 since the anode 25 is disposed on the same plane as that of the wedge-shaped micro tip 23*a*. For this reason, the bias voltage applied to the gate should be relatively large, and a structure by which a flow of electrons can be concentrated is necessitated to facilitate the emission of the electrons with a low bias voltage.

SUMMARY OF THE INVENTION

To solve the above problems, it is an object of the present invention to provide a lateral field emission display having micro tips, which enables the uniform emission of electrons, facilitates the forming of a fluorescent film for an image display and makes the electron emission easy with a low bias voltage.

Accordingly, to achieve the above object, there is provided a lateral field emission display according to a first embodiment of the present invention, which includes a lower substrate, a cathode having a plurality of micro tips whose upper portions are laterally formed on the lower substrate, an insulating layer formed on the cathode being separated from the micro tips by a predetermined distance, a plurality of anodes formed on the insulating layer being separated from the micro tips by a set distance, and a fluorescent material coated on the anodes, in which each of the micro tips of the cathode is formed to have a predetermined angled surface with respect to a lateral surface of the substrate.

It is preferred in the present invention that the cathode is formed of Si, that the angle is 60°–75° and that the anodes are formed of material selected from the group consisting of chromium (Cr) and molybdenum (Mo).

To achieve the above object, there is provided a method for fabricating a lateral field emission display according to the first embodiment of the present invention, which comprises the steps of forming a first mask on a semiconductor layer, forming a micro tip portion by performing a directional etching at a predetermined angle using the first mask through a reactive ion etching method, etching the first mask and forming an oxide film on a surface of the semiconductor layer where the micro tip portion is formed, forming an anode by depositing and patterning a predetermined metal on the oxide film formed on a lower surface of the cathode, removing the oxide film on the micro tip portion leaving the oxide film on the lower portion of the cathode as an insulating layer by using the anode as a second mask, coating a fluorescent material on the anode, and mounting the semiconductor layer with the cathode and anode on a glass substrate.

It is preferred in the present invention that the first mask is formed of chromium (Cr), that the directional anisotropic etching is performed at an angle of 60°–75° with respect to a lateral surface of the cathode, that the second mask is formed of material selected from the group consisting of chromium (Cr) and molybdenum (Mo) and that the fluorescent material adheres through an electrophoretic method.

To achieve the above object, there is provided a lateral field emission display according to a second embodiment of the present invention, including a substrate, a cathode having a plurality of laterally sharpened micro tips formed on the substrate, a gate formed on the substrate the gate being spaced from the micro tips by a set distance, an anode formed atop insulating layer on the substrate the anode being spaced from the gate with respect to the micro tips, wherein each of the micro tips comprises a portion shaped as a polygonal body with a spear-shaped tip portion with respect to the gate.

It is preferred in the present invention that a slanted surface of the tip portion of each micro tip is formed to have an angle of 60°–75° with respect to a surface of the substrate.

To achieve the above object, there is provided a method for fabricating a lateral field emission display according to the second embodiment of the present invention, which includes the steps of forming a silicon layer on a substrate, forming a pentagonal shaped mask having a sharpened portion by depositing metal on the silicon layer and patterning the deposited metal, forming a micro tip having a spear-shaped tip portion on the silicon layer by anisotropy etching using the mask, removing the mask, forming an insulating layer on the whole surface of the substrate where the micro tip is formed, forming a gate and an anode on the insulating layer laterally spaced from the micro tip, and selectively etching the insulating layer using the gate and the anode as masks.

It is preferred in the present invention that the mask is formed of aluminum (Al) and that the micro tip forming step includes the steps of forming a micro tip structure by anisotropy etching the silicon layer in a vertically downward direction through a reactive ion etching method using $CF_4/O_2$ plasma and forming the tip portion of the micro tip structure into a spear tip shape by anisotropy etching the micro tip structure at an angle of 60°–75° through the reactive ion beam etching (RIBE) method using $CF_4/O_2$ plasma.

It is also preferred in the present invention that the insulating layer is formed by depositing a $SiO_2$ film, that the gate and the anode are formed by a lift-off method, that the insulating layer a wet chemical etching method is employed in the selectively etching step and that the Al mask is removed by a wet etching method.

To achieve the above object, there is provided a lateral field emission display according to a third embodiment of the present invention, which includes a substrate, a cathode having a plurality of micro tips, sharpened in a lateral direction on the substrate, each of which is formed to have a spear-tip shape to thereby emit electrons from a signal point, a first gate formed on the cathode with a first insulating layer interposed therebetween, a second gate formed on the substrate with the second insulating layer interposed therebetween, and an anode formed on the substrate with the third insulating layer interposed therebetween being separated from the second gate in a lateral direction.

It is preferred in the present invention that the micro tip comprises a portion shaped as a polygonal body with a spear-tip shaped tip portion, that a slanted surface of the tip portion of each micro tip is formed to have a predetermined angle and that the anode is formed to be higher than the second gate.

To achieve the above object, there is provided a method for fabricating a lateral field emission display according to the third embodiment of the present invention, which includes the steps of forming a silicon layer on a substrate, forming a pentagonal shaped mask having a sharpened portion by depositing metal on the silicon layer and patterning the deposited metal, forming a micro tip having a spear-shaped tip portion on the silicon layer by an anisotropy etching using the mask, removing the mask, forming a lower insulating layer on the whole surface of the substrate where the micro tip is formed, forming an upper insulating layer on the lower insulating layer, forming an anode on the upper insulating layer laterally spaced from the micro tip, selectively etching the upper insulating layer using the anode as a mask, forming first and second gates atop the lower insulating layer wherein the first gate is formed above the micro tips and the second gate is formed between the first gate and the anode, and selectively etching the lower insulating layer using the first and second gates and the anode as masks.

It is preferred in the present invention that the mask is formed of aluminum (Al), that the micro tip forming step includes the steps of forming a micro tip structure by anisotropy etching the silicon layer in a vertically downward direction through a reactive ion etching method using $CF_4/O_2$ plasma and forming the tip portion of the micro tip structure into a spear tip shape by anisotropy etching the micro tip structure at an angle of 60°–75° through the reactive ion beam etching (RIBE) method using $CF_4/O_2$ plasma.

It is also preferred in the present invention that the lower insulating layer is formed by depositing a $SiO_2$ oxide film and that the upper insulating layer is formed by depositing nitride through a plasma-strengthen chemical evaporation means.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
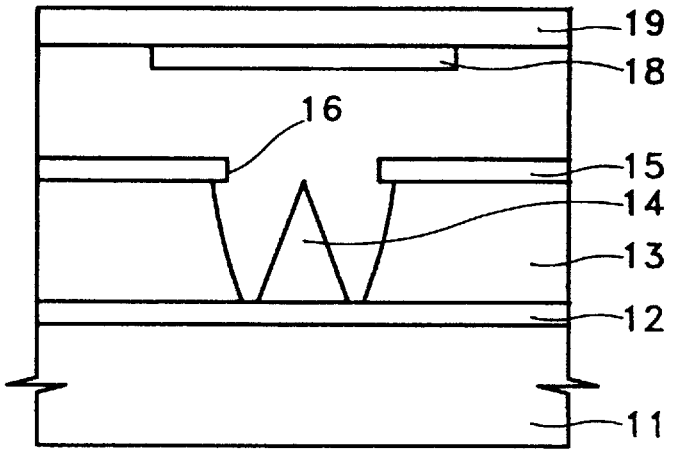
FIG. 1 (PRIOR ART)
FIG. 1 is a vertical section illustrating a conventional vertical field emission display.
Figure 2:
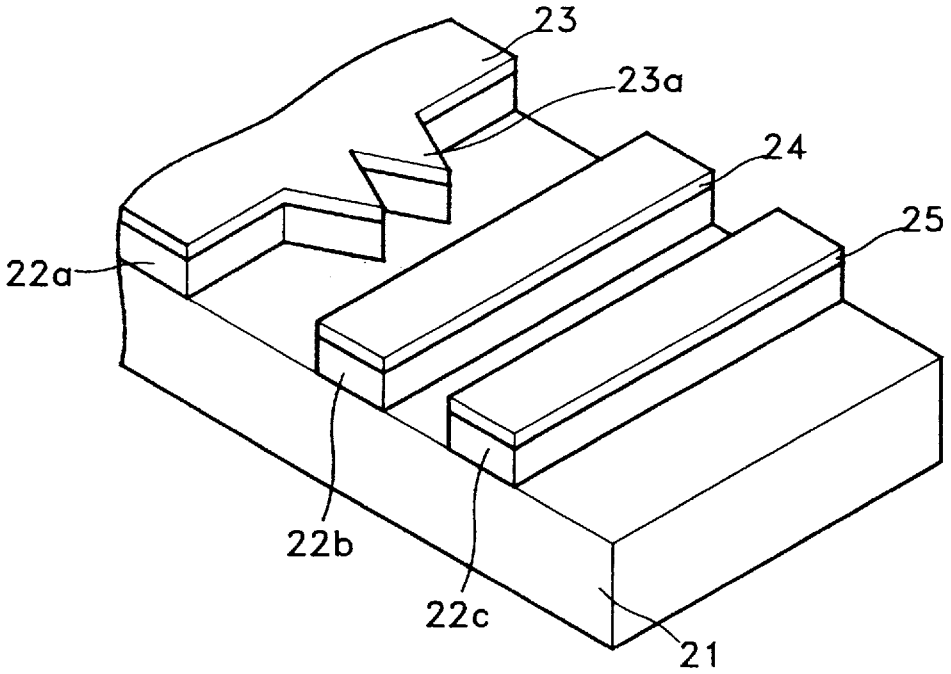
FIG. 2 (PRIOR ART)
FIG. 2 is a perspective view schematically illustrating a conventional lateral field emission display.
Figure 3A:
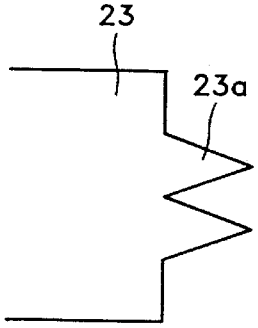
FIG. 3A (PRIOR ART)
FIG. 3A is a plan view illustrating a micro tip portion of the lateral field emission display as sown in FIG. 3A.
Figure 3B:
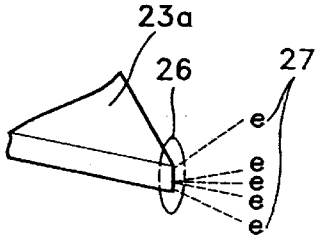
FIG. 3B (PRIOR ART)
FIG. 3B is a view for explaining the projection angles of electrons emitted from a tip portion of the micro tip of the lateral field emission display of FIG. 2.
Figure 4:
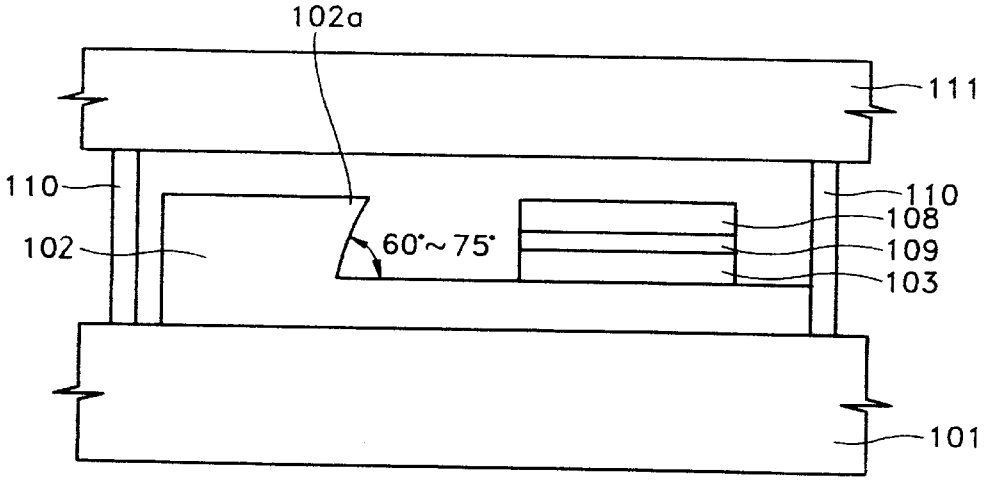
FIG. 4 is a vertical section illustrating a unit cell of a lateral field emission display according to the present invention.

FIG. 4 is a vertical sectional view of a unit cell of a lateral field emission display according to a first embodiment of the present invention. Referring to the drawing, the lateral field emission display comprises: a lower glass substrate 101; a cathode 102 having a micro tip 102*a* with its upper portion sharpened in a lateral direction by etching a silicon layer formed on the rear glass substrate 101; an insulating layer 103 formed on the cathode 102 at a set distance from the micro tip 102*a*; an anode 109 formed on the insulating layer 103 at a set distance from the micro tip 102*a*; a fluorescent material 108 coated on the anode 109; an upper glass substrate 111; and a spacer 110 for keeping the upper glass substrate 111 at a set distance from the lower glass substrate 101. Here, it is characteristic in the present invention that the micro tip 102*a* is preferably tilted at about 60°–75° with respect to the silicon cathode 102.

Referring to FIGS. 5A–5H, a method for fabricating a lateral field emission display having such a structure will be described.

Figure 5A:
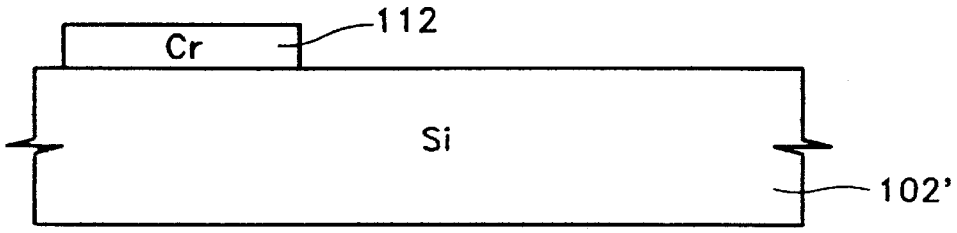
FIGS. 5A–5H are vertical sections illustrating each processing step of fabricating the lateral field emission display of FIG. 4.

As shown in FIG. 5A, chromium (Cr) is deposited on a silicon substrate 102' through an E-beam depositing method or a sputtering method. Then, a first metal mask 112 for forming a micro tip is formed by wet-etching or plasma etching. A cathode (the micro tip) formed of the silicon substrate 102' has a merit in that the field emission display can uniformly emit electrons at a high temperature.

Figure 5B:
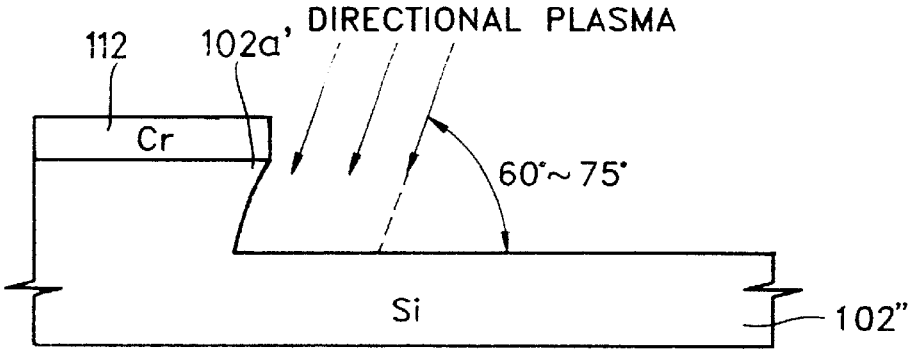

Next, as shown in FIG. 5B, a micro tip portion 102*a*' is formed at an angle of 60°–75° with respect to the lateral plane by etching the silicon substrate 102' under the mask 112 through a reactive ion beam etching (RIBE) method using a directional plasma having a tilt of about 60°–75° with respect to a lateral surface.

Figure 5C:
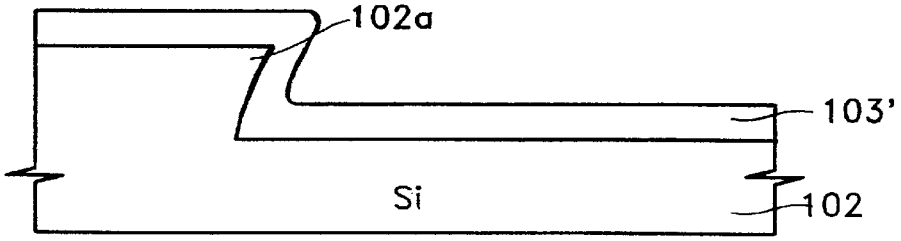

The first metal mask 112 is removed, and an oxidation layer 103' is formed by oxidizing the surface of the silicon substrate 102' as shown in FIG. 5C to form a sharper micro tip. In such a way, the micro tip 102*a* of an atomic dimension is formed.

Figure 5D:
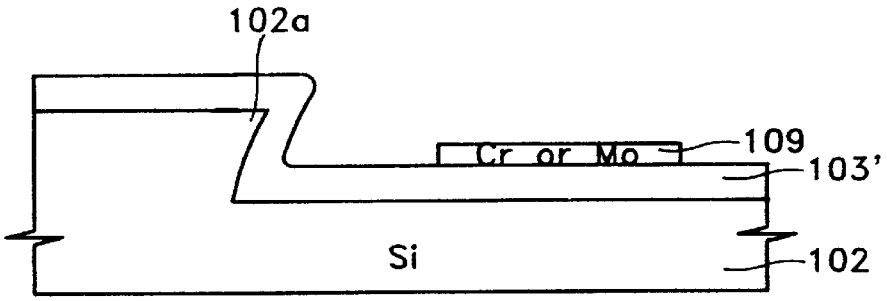

In FIG. 5D, a second metal mask 109 is formed by depositing Cr or Mo on the oxidation layer 103' and patterning it.

Figure 5E:
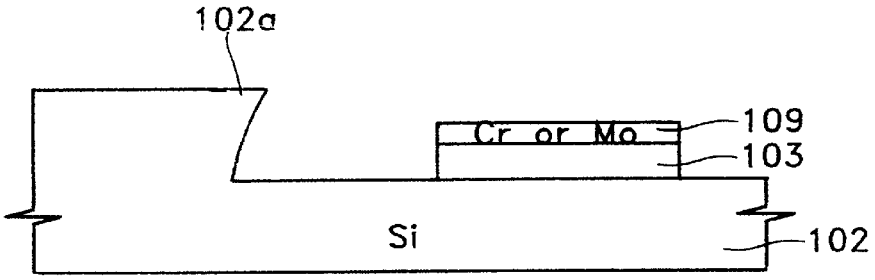

In FIG. 5E, an insulating layer 103 is formed by removing the excess oxidation layer 103' around the micro tip 102*a* by etching it using the second metal mask 109. During the etching of the oxidation layer 103', a sharp micro tip 102*a* is exposed by dipping the silicon substrate 102 into a BOE (buffered oxide etching) etchant which is a HF:$NH_4F$ solution of which the ratio is 7:1~10:1. The second metal mask 109 used in the oxidation layer 103' etching for forming the insulating layer 103, functions as an anode. Accordingly, since the oxidation layer 103' and the second metal mask 109 are the insulating layer 103 and anode 109, respectively, the fabricating process is simplified.

Figure 5F:
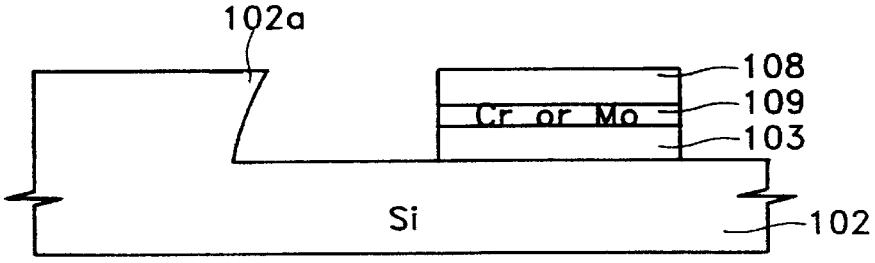

Next, as shown in FIG. 5F, a fluorescent material 108 is deposited on the anode 109 (the second metal mask), and selectively adheres to it through an electrophoretic method using the anode 109 as an electrode. There is no need to make the thickness of the fluorescent material considerably thin as in a vertical field emission display, since light emitted from the fluorescent material does not pass through the fluorescent material but is emitted to the upper glass substrate and reflected therefrom.

Figure 5G:
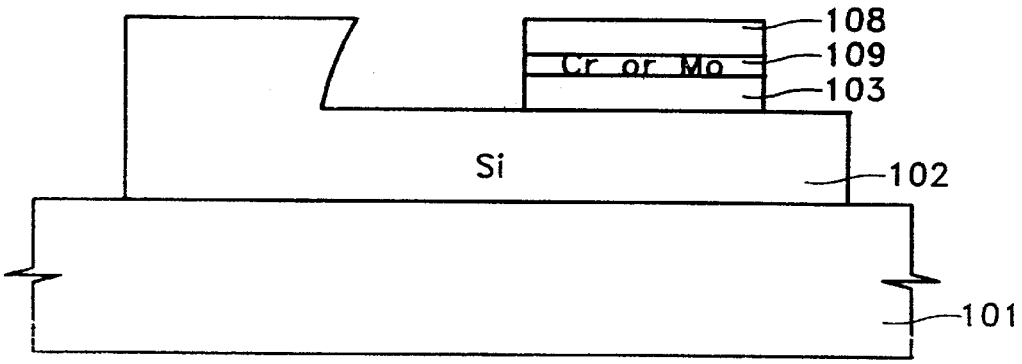

In FIG. 5G, the silicon cathode 102 is mounted on the lower glass substrate 101.

Figure 5H:
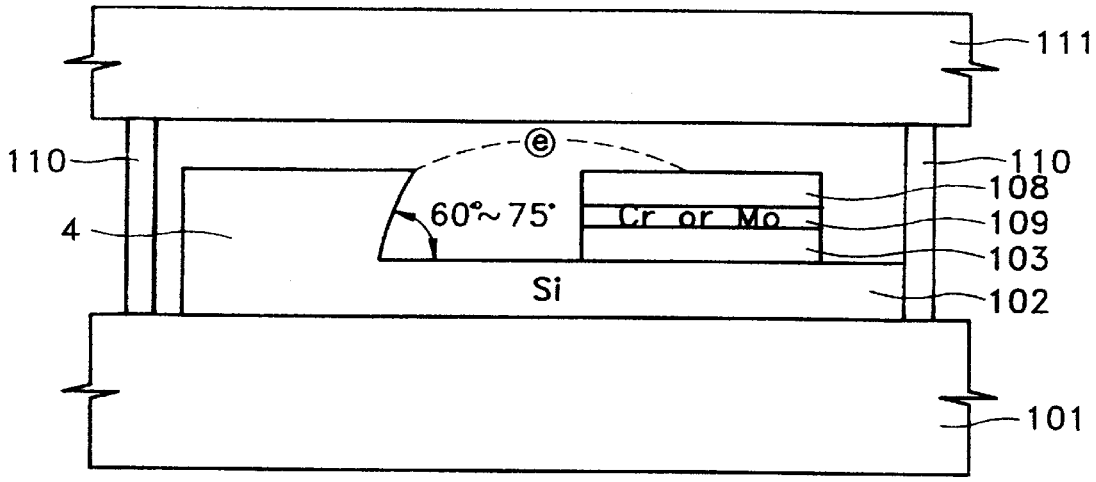

In FIG. 5H, the upper glass substrate 111 is arranged above the lower glass substrate 101 where the cathode 102 is mounted, and separated therefrom by a spacer 110. Then, the interior thereof is evacuated to form a vacuum.

In the lateral field emission display formed in such a way, when the cathode 102 is grounded and an appropriate voltage is applied to the anode 109 (the second metal mask), electrons are emitted from the micro tip 102*a* due to a strong electric field to strike the fluorescent material 108. The fluorescent material 108 emits light corresponding to the energy of the striking electrons. The emitted light is transmitted through the front glass substrate 111, rather than passing through the fluorescent material, to thereby be displayed. Hence, the function as a flat light-emitting device or a flat display device is performed.

Figure 6:
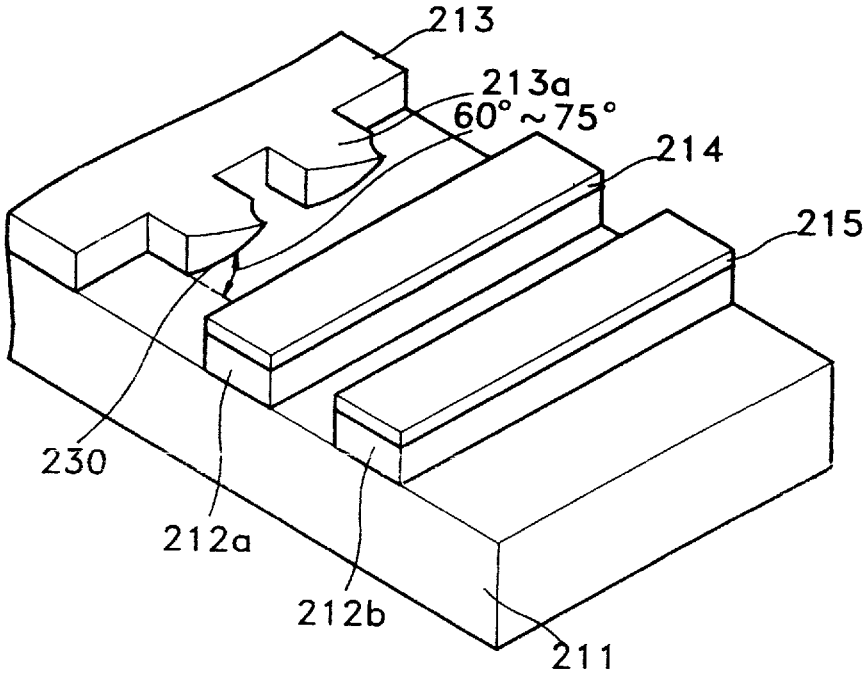
FIG. 6 is a perspective view schematically illustrating a lateral field emission display according to another preferred embodiment of the present invention.

FIG. 6 is a perspective view schematically illustrating a lateral field emission display according to a second preferred embodiment of the present invention. In the second embodiment as shown in the drawing, the lateral field emission display comprises: a substrate 211; a cathode 213 where laterally sharpened micro tips 213*a* are formed on the substrate 211; a gate 214 and anode 215 separated by a set distance in a lateral direction with respect to the micro tips 213*a*; insulating layers 212*a* and 212*b* for electrically isolating the gate 214 and anode 215 from the substrate 211, respectively.

Figure 7A:
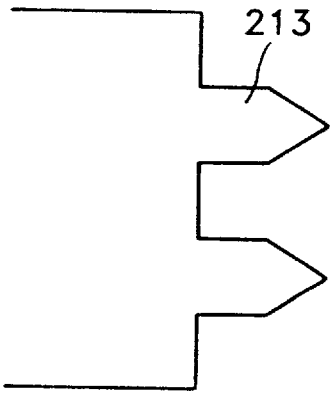
FIG. 7A is plan view illustrating the lateral field emission display of FIG. 6.

As shown in FIGS. 6 and 7A, the tip portion of the micro tip 213*a* is formed to have a sharp shape like the tip of a spear to emit electrons from one point thereof, which is a characteristic portion of the present invention. In particular, the micro tip 213*a* is formed to have a spear-like tip with a polygonal connecting portion, and a slant 230 of the tip portion is formed to have an angle of 60°–75° with respect to a substrate surface to sharpen the tip portion in three-dimensions.

Referring to FIGS. 7B–7F, the method for fabricating the second embodiment of such a structure will now be described.

Figure 7B:
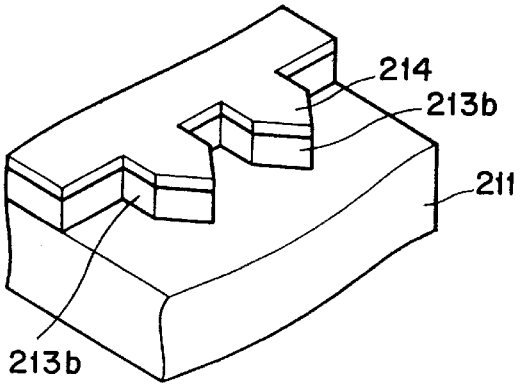
FIGS. 7B–7D are vertical sections illustrating each processing step of fabricating a micro tip portion of the lateral field emission display of FIG. 6.
Figure 7C:
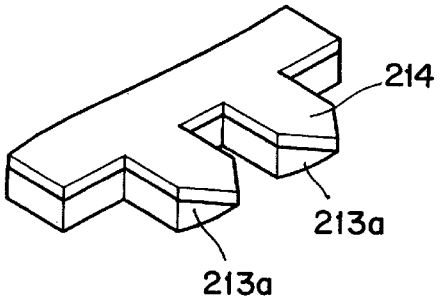

Primarily, a silicon layer for forming a cathode and micro tip is formed by growing silicon on the substrate 211. A pentagonal mask 214 having a tip portion is formed as shown in FIG. 7B by depositing a metal for forming a mask on the silicon layer and patterning the silicon layer. Here, Al is used for the mask-forming material. Then, a micro tip structure 213*b* is formed using the mask 214 by vertically anisotropy-etching the silicon layer through a reactive ion beam etching method using $CF_4/O_2$ plasma. Then, the tip portion of the micro tip structure 213*b* is etched to be sharpened as a spear tip shape 213*a* as shown in FIG. 7*c* by anisotropy etching the micro tip structure 213*b* to have an angle of 60°–75° with respect to the lateral plane through the reactive ion beam etching method using $CF_4/O_2$ plasma.

Figure 7D:
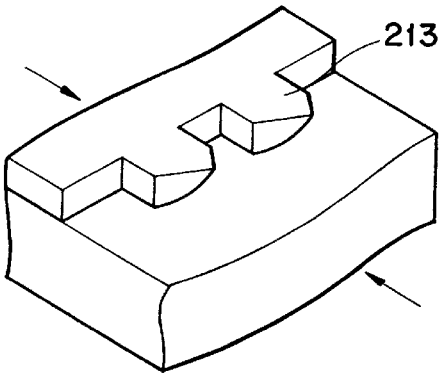

As shown in FIG. 7D, the cathode 213 having the complete micro tip 213*a* is formed by removing the mask.

Figure 7E:
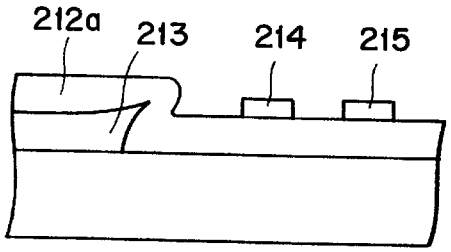
FIGS. 7E–7F are vertical sections illustrating each processing step of fabricating a gate and an anode of the lateral field emission display of FIG. 6.

In FIG. 7E, an insulating layer 212*a* is formed by depositing a $SiO_2$ oxidation layer through a high temperature process throughout the whole upper surface of the substrate where the silicon micro tip 213 is formed. Here, the high temperature process for forming the $SiO_2$ oxidation layer causes stress which contributes to a slight swelling-up of the tip portion of the micro tip 213 when the oxidation layer is removed later. The gate 214 and the anode 215 are formed on the insulating layer and separated by an appropriate distance in a lateral direction with respect to the micro tip 213. Here, the gate 214 and the anode 215 are formed through a lift-off method.

Figure 7F:
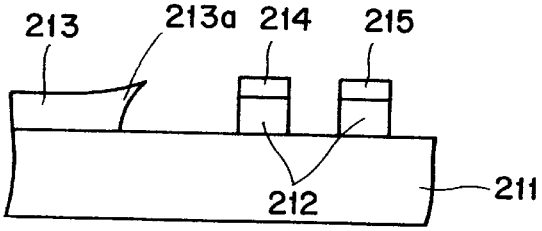

The unnecessary portion of the insulating layer 212*a* is etched through a wet chemical etching method using the gate 214 and anode 215 as masks. Thus, as shown in FIG. 7F, the insulating layer 212 is left only below the gate 214 and anode 215 to thereby complete the device. Here, the tip portion 213*a* of the micro tip 213 swells upward due to the stress caused by the formation of the high-temperature oxidation layer.

In the lateral field emission display fabricated in the above way, when 50–80V and 150–200V are applied to the gate 214 and the anode 215, respectively, with the micro tip being grounded, electrons move to the anode. When the fluorescent material is coated on the anode where electrons are concentrated, the fluorescent material is excited to thereby emit light. In particular, since the spear-shaped tip portion of the micro tip corresponding to the anode is sharp, concentration of the electrons becomes smooth. Hence, a low voltage driving is made possible.

Figure 8:
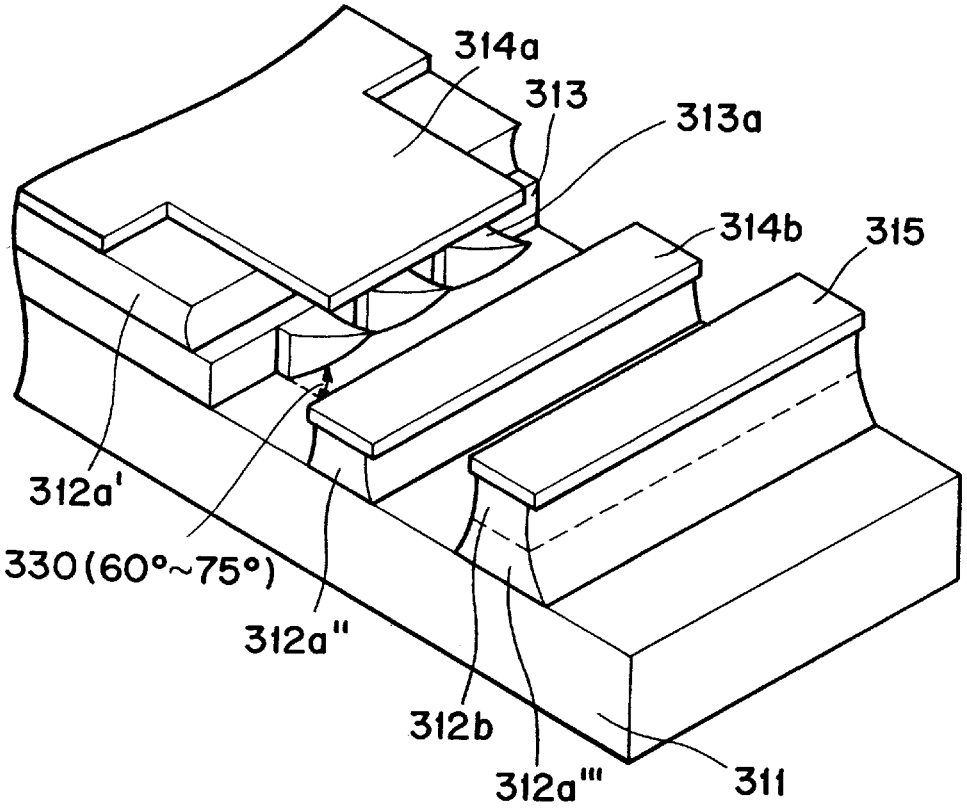
FIG. 8 is a perspective view of a lateral field emission display according to yet another preferred embodiment of the present invention.

FIG. 8 shows a lateral field emission display according to a third embodiment of the present invention. As shown in the drawing, the third embodiment comprises a substrate 311, a cathode 313 having micro tips 313*a* laterally sharpened which are formed on the substrate 311, a first insulating layer 312*a*' formed on the cathode 313, a first gate 314*a* formed on the first insulating layer 312*a*' above the cathode 313, a second gate 314*b* and an anode 315 separated by a set distance in a lateral plane with respect to the micro tips 313*a*, second and third insulating layers 312*a*" and 312*a*'" for electrically isolating the second gate 314*b* and the anode 315 from the substrate 311, respectively.

Figure 9A:
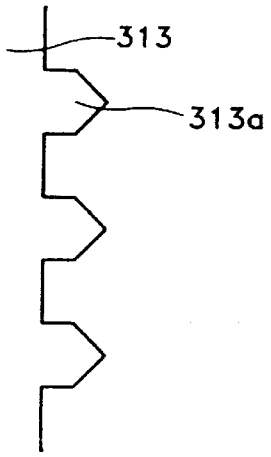
FIG. 9A is a plan view of a micro tip portion of the lateral field emission display of FIG. 8.
Figure 9B:
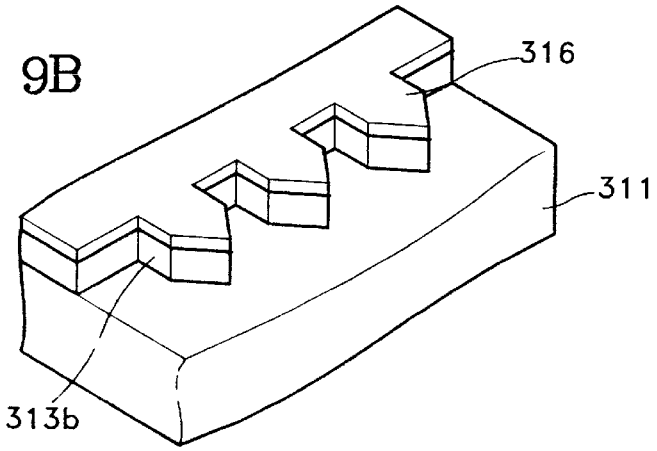
FIGS. 9B–9D are vertical sections illustrating each processing step of fabricating the micro tip portion of the lateral field emission display of FIG. 8.
Figure 9C:
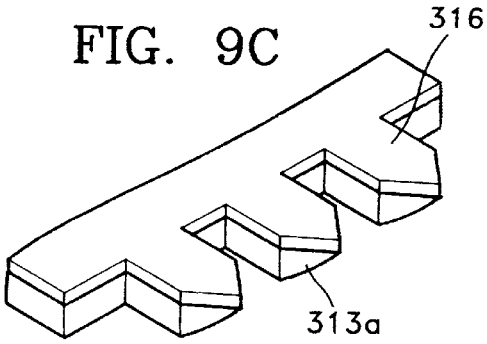

Particularly, it is a characteristic portion in the present invention that, as shown in FIG. 9A, the micro tip 313*a* has a pentagonal shape and has a tip portion which is formed to be sharp like that of a spear with respect to the gate 314*b* so as to emit electrons from a point thereof. Also, the anode 315 is formed to be higher than the second gate 314*b* as shown in FIG. 9H. When the anode 315 is formed to be higher than the second gate 314*b* as above, concentration efficiency of an electron beam emitted from the micro tip 313*a* is improved. Also, the micro tip 313*a* having the spear-shaped tip portion includes a connecting portion shaped as a polygonal body as shown in FIG. 9C. To sharpen the tip portion, a slanted surface 330 (FIG. 8) of the tip portion is formed to have a tilt of 60°–75° with respect to a substrate surface.

Referring to FIGS. 9B–9H, the fabricating method of the third embodiment having such a structure is as follows.

Primarily, a silicon layer for forming a cathode and micro tip is formed by growing silicon on the substrate 311. A pentagonal shaped mask 316 having a tip portion is formed as shown in FIG. 9B by depositing a metal for forming the mask on the silicon layer and patterning the deposited metal. Here, Al is used for the mask-forming material. Then, a micro tip structure 313*b* is formed using the mask 316 by vertically anisotropy-etching the silicon layer through a reactive ion etching method using $CF_4/O_2$ plasma. Then, the tip portion of the micro tip structure 313*b* is etched to be sharpened to a spear-tip shape 313*a* as shown in FIG. 9C by anisotropy etching the micro tip structure 313*b* to have an angle of 60°–75° through the reactive ion beam etching method using $CF_4/O_2$ plasma.

Figure 9D:
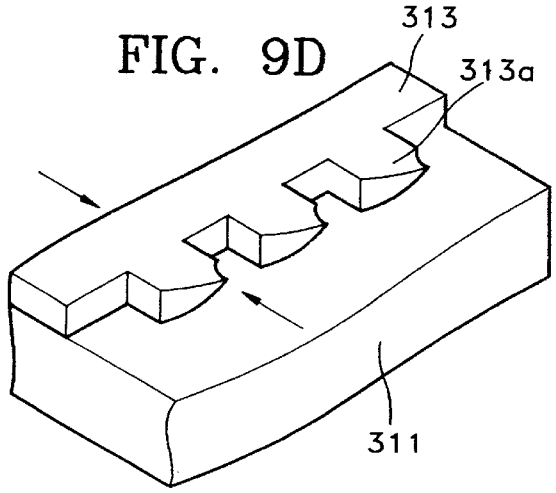

As shown in FIG. 9D, the cathode 313 having the complete micro tip 313*a* is formed by removing the mask.

Figure 9E:
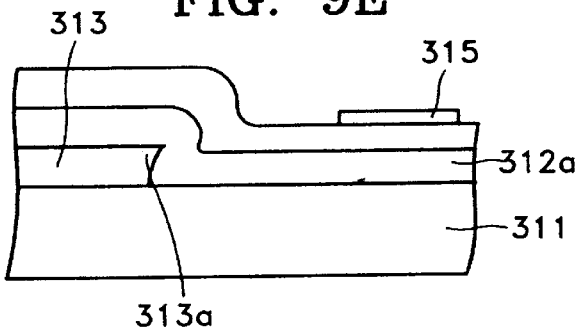
FIGS. 9E–9H are vertical sections illustrating each processing step of fabricating a gate and an anode of the lateral field emission display of FIG. 8.

In FIG. 9E, the lower insulating layer 312*a* is formed by depositing a $SiO_2$ oxidation layer 316 through a high temperature process on the whole upper surface of the substrate where the silicon micro tip 313*a* is formed. Here, the high temperature process used to form the lower insulating layer causes stress which is applied as a force to slightly swell the tip portion up when the micro tip 313*a* is exposed later. Next, an upper insulating layer 312*b* is formed by depositing nitride on the lower insulating layer 312*a* through a plasma enhanced chemical vapor deposition (PECVD) method. The anode 315 is formed on the upper insulating layer 312*b* to have an appropriate distance in a lateral direction with respect to the micro tip 313*a*. Here, the anode 315 is formed through a lift-off method.

Figure 9F:
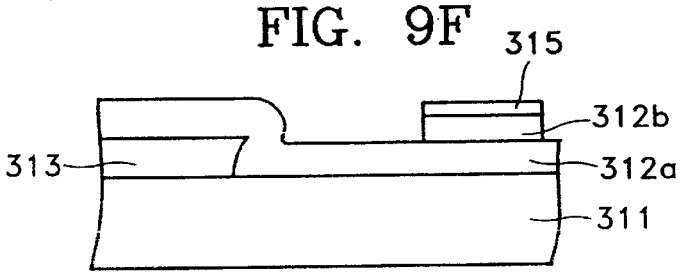

Next, an unnecessary portion of the upper insulating layer 312*b* is etched using the anode 315 as a mask through a wet chemical etching method. Accordingly, as shown in FIG. 9F, the nitride upper insulating layer 312*b* is left below only the anode 315.

Figure 9G:
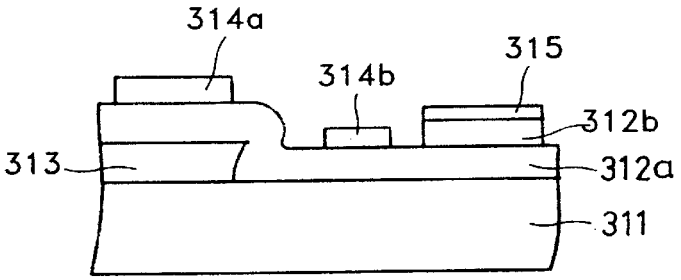
Figure 9H:
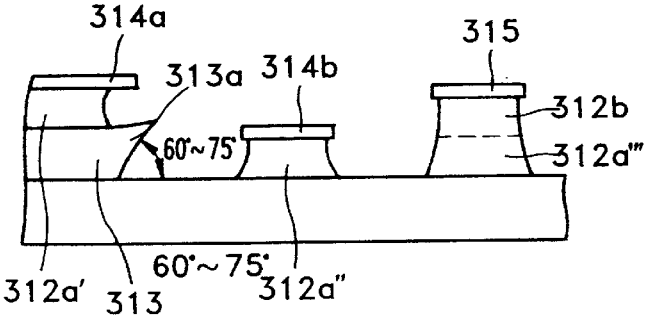

In FIG. 9G, the first and second gates 314*a* and 314*b* are formed through the lift-off method above the cathode 313 and on an upper surface of the lower insulating layer 312*a* between the micro tip 313*a* and the anode 315, respectively.

Then, as shown in FIG. 9H, the lower insulating layer 312*a* is selectively etched using the first and second gates 314*a* and 314*b* and the anode 315 as masks to thereby complete the device. At the time when the micro tip 313*a* is exposed, the end of the tip portion thereof slightly swells up due to the stress generated in the high temperature process (the lower insulating layer forming process).

In the lateral field emission display fabricated in such a way, when the micro tip thereof is grounded and a positive bias voltage of 50–100V is applied to the first and second gates 314*a* and 314*b*, electrons are emitted. At the time, when 150–200V is applied to the anode 315, the electrons are concentrated on the anode 315. When the fluorescent material is coated on the anode 315 where the electrons are concentrated as above, the fluorescent material is excited by the impact energy of the electrons and light is then emitted. In particular, since the tip portion of the micro tip with respect to the anode is sharp, the concentration of electrons is smooth and a low voltage driving is made possible.

As described above, the lateral field emission display according to the present invention where electric field effect is laterally generated by forming the cathode and anode laterally so as to emit electrons has the following advantages.

First, since the impact direction of plasma ions is properly adjusted during the reactive ion beam etching, the angle of the micro tip can be uniformly controlled and yield is high.

Second, since the oxidation layer and the second metal mask formed in the oxidation sharpness process and the second metal mask forming process are used as the insulating layer and anode, respectively, the fabricating process can be simplified.

Third, since the fluorescent material selectively adheres to the anode by an electrophoretic method, a clear fluorescent material can be obtained.

Fourth, since the cathode is fabricated using a silicon substrate which can be operated in a high temperature and mounted on the glass substrate, efficiency in a fabricating process is increased and an amount of emission current can be easily controlled.

Fifth, since the micro tip is formed to be sharp through the reactive ion beam etching method, efficiency of electron emission is better than in a conventional wedge-type tip. Also, since focusing of an electron beam is accurately controlled, a relatively low-voltage driving is possible.

Sixth and last, since the first gate is further provided above the cathode and the anode is formed to be higher than the second gate, a trace control of an electron-beam emitted from the micro tip is easy and focusing efficiency of the emitted electron beam to the anode is also improved.

The present invention has been described by way of exemplary embodiments to which it is not limited. Variations and modifications will occur to skilled artisans without departing from the spirit and scope of the invention recited in the claims appended hereto.

What is claimed is:

1. A lateral field emission display including a lower substrate:

a cathode having a plurality of micro tips whose upper portions are laterally formed on said lower substrate;

an insulating layer formed on lower portion of said cathode being separated from said micro tips by a predetermined distance;

a plurality of anodes formed on said insulating layer being separated from said micro tips by a set distance; and a fluorescent material coated on said anodes, wherein each of said micro tips of said cathode is formed to have a predetermined angled surface with respect to a lateral surface of said lower substrate and wherein an end of said micro tips of said cathode is swelled up away from said lower substrate.

2. A lateral field emission display as claimed in claim 1, wherein said cathode is formed of silicon.

3. A lateral field emission display as claimed in claim 1, wherein said angle is 60°–75°.

4. A lateral field emission display as claimed in claim 1, wherein said anodes are formed of material selected from the group consisting of chromium (Cr) and molybdenum (Mo).

5. A lateral field emission display including a substrate;

a cathode having a plurality of laterally sharpened micro tips on said substrate;

a first insulating layer formed on said substrate being separated from said micro tips by a predetermined distance;

a second insulating layer formed on said substrate being separated from said first insulating layer by a predetermined distance;

a gate on said first insulating layer;

an anode on said second insulating layer, wherein each of said micro tips comprises a portion shaped as a polygonal body with a spear-shaped tip portion and wherein an end of each of said micro tips of said cathode is swelled up away from said substrate.

6. A lateral field emission display as claimed in claim 5, wherein a slanted surface of said tip portion of each micro tip is formed to have a predetermined angle with respect to a surface of said substrate.

7. A lateral field emission display comprising:

a substrate;

a cathode having a plurality of micro tips, sharpened in a lateral direction on said substrate, each of which is formed to have a spear-tip shape to thereby emit electrons from a single point;

a first gate formed on said cathode with a first insulating layer interposed therebetween;

a second gate formed on said substrate with a second insulating layer interposed therebetween; and an anode formed on said substrate with a third insulating layer interposed therebetween being separated from said second gate in a lateral direction.

8. A lateral field emission display as claimed in claim 7, wherein each of said plurality of micro tips comprises a portion shaped as a polygonal body with a spear-tip shaped tip portion.

9. A lateral field emission display as claimed in claim 8, wherein a slanted surface of said tip portion of each micro tip is formed to have a predetermined angle.

10. A lateral field emission display as claim in claim 9, wherein said anode is formed to be higher than said second gate.

* * * * *